US011179738B2

(12) United States Patent
Zhang

(10) Patent No.: US 11,179,738 B2
(45) Date of Patent: Nov. 23, 2021

(54) VISCOUS DAMPED STREAM ROTARY DEFLECTOR WITH INTERNAL SPIRALED DAMPING RIBS

(75) Inventor: Richard Zhang, Riviera Beach, FL (US)

(73) Assignee: K-Rain Manufacturing Corp., Riviera Beach, FL (US)

( * ) Notice: Subject to any disclaimer, the term of this patent is extended or adjusted under 35 U.S.C. 154(b) by 816 days.

(21) Appl. No.: 13/434,316

(22) Filed: Mar. 29, 2012

(65) Prior Publication Data

US 2012/0273592 A1 Nov. 1, 2012

Related U.S. Application Data

(60) Provisional application No. 61/468,810, filed on Mar. 29, 2011.

(51) Int. Cl.
*B05B 3/00* (2006.01)
*B05B 15/74* (2018.01)

(52) U.S. Cl.
CPC ..... *B05B 3/005* (2013.01); *B05B 15/74* (2018.02)

(58) Field of Classification Search
CPC ..... B05B 3/005; B05B 15/10; B05B 8/058; B05B 15/74
USPC ..... 239/214, 214.13
See application file for complete search history.

(56) References Cited

U.S. PATENT DOCUMENTS

| | | | | |
|---|---|---|---|---|
| 3,029,028 | A * | 4/1962 | Skerritt | B05B 15/625 239/252 |
| 3,557,574 | A * | 1/1971 | Avery | 464/38 |
| 6,244,521 | B1 * | 6/2001 | Sesser | 239/222.17 |
| 2002/0166900 | A1 * | 11/2002 | Sesser | B05B 15/74 239/204 |
| 2005/0040256 | A1 * | 2/2005 | Santos | B05B 3/003 239/380 |
| 2008/0257982 | A1 * | 10/2008 | Kah | B05B 1/265 239/222.11 |

* cited by examiner

*Primary Examiner* — Qingzhang Zhou
(74) *Attorney, Agent, or Firm* — Amster, Rothstein & Ebenstein LLP

(57) ABSTRACT

A viscous damped deflector in accordance with an embodiment of the present disclosure includes at least one sloped spiral rim extending from a lower surface of a top of the viscous damping chamber that rotates with the rotating distributor of the damped deflector, such that viscous fluid in the chamber is pumped to the center of the chamber as the distributor rotates.

15 Claims, 3 Drawing Sheets

VISCOUS DAMPED STREAM ROTARY DEFLECTOR WITH INTERNAL SPIRALED DAMPING RIBS

CROSS-REFERENCE TO RELATED APPLICATION

The present application claims benefit of and priority to U.S. Provisional Patent Application Ser. No. 61/468,810, entitled "Viscous Damped Stream Rotary Deflector with Internal Spiraled Damping Ribs", filed on Mar. 29, 2011, the entire content of which is hereby incorporated by reference herein.

BACKGROUND

Field of the Disclosure

The present disclosure relates to a rotary sprinkler including a viscous damped deflector that includes internal sloped spiral damping ribs.

Related Art

Co-pending U.S. patent application Ser. No. 12/348,864 filed January 5, 2009 entitled ARC AND RANGE OF COVERAGE ADJUSTABLE STREAM ROTOR SPRINKLER and published as U.S. Patent Publication No. 2009/0173803 on Jul. 9, 2009 provides a good explanation of viscous damped deflector assemblies and is hereby incorporated by reference herein in its entirety.

In general, viscous damping or speed control elements are used to limit the speed of rotation of a distributor, or deflector in a rotary sprinkler. A problem may arise in such damping or speed control elements if water or air enters the viscous chamber of the speed control element. The water and/or air may affect the viscosity of the fluid in the chamber, which may reduce the effectiveness of the speed control.

Accordingly it would be beneficial to provide a distributor for a rotary sprinkler that avoids these and other problems.

SUMMARY

The present disclosure discloses a rib or ribs molded onto a lower surface of an upper bearing member of a viscous damping chamber that interfaces with the rotationally stationary part inside of a rotating stream distributor. The rib(s) may be molded onto the inside surface of the bottom of the chamber to interface with the rotationally stationary viscous damping member. The spiral shaped and sloped ribs, in a preferred configuration, interact with the viscous fluid that fills most of the clearance between stationary and rotating parts in the chamber to pump the fluid toward the center of rotation. This builds up viscous fluid pressure on the leading edge of these inwardly spiraled ribs. As a result, any water or air in the chamber is moved out to the low pressure trailing edges of these ribs and then is moved to the outside circumference of the chamber and up the sidewalls of the chamber, thus clearing air and any water to the top of the damping chamber.

A viscous damped sprinkler in accordance with an embodiment of the present application includes inwardly sloped spiral ribs on the moving surfaces of a viscous damping cavity to interact with the internal stationary member's surfaces to force air or water to the outside and top of the cavity out of the damping boundary layer areas.

In an embodiment, a small deflector may be mounted on the rotation support shaft just below the rotating stream distributor rotating joint to protect the rotating joint from water entry into its internal viscous cavity.

A distributor of a rotary sprinkler in accordance with an embodiment of the present application includes a housing member including a plurality of curved grooves formed on a bottom surface thereof to impart torque on the distributor as water flows through the grooves, a shaft positioned along a central axis of the distributor and extending through the distributor such that the distributor is rotatable on the shaft, a viscous chamber formed in the housing and including a viscous material, a stator, fixed to the shaft and positioned in the viscous chamber, and a bearing provided in a top surface of the housing member, configured to rotatably connect the distributor to the shaft and to form a top of the viscous chamber, such that the distributor rotates on the shaft. The bearing includes at least one rib formed on a bottom surface thereof and extending toward the stator, the rib having a spiral shape and inclined inward toward the shaft.

A sprinkler head assembly in accordance with an embodiment of the present application includes a nozzle housing including an inlet for pressurize water and an outlet downstream of the inlet and a rotating deflector, mounted on a central shaft extending through the nozzle housing and operable to deflect a flow of water out of the nozzle assembly. The deflector includes a housing member including a plurality of curved grooves formed on a bottom surface thereof to impart torque on the distributor as water flows through the grooves and is directed out of the nozzle assembly such that the deflector rotates on the central shaft, a viscous chamber formed in the housing member and including a viscous material, a stator, fixed to the central shaft and positioned in the viscous chamber and a bearing provided in a top surface of the housing member and configured to rotatably connect the distributor to the central shaft and to form a top of the viscous chamber. The bearing includes at least one rib formed on a bottom surface thereof and extending toward the stator, the rib having a spiral shape and inclined inward toward the shaft.

A distributor of a rotary sprinkler in accordance with an embodiment of the present application includes a housing member including a plurality of curved grooves formed on a bottom surface thereof to impart torque on the distributor as water flows through the grooves, a shaft positioned along a central axis of the distributor and extending through the distributor such that the distributor is rotatable on the shaft, a viscous chamber formed in the housing and including a viscous material, a stator, fixed to the shaft and positioned in the viscous chamber; and a bearing provided in a top surface of the housing member, configured to rotatably connect the distributor to the shaft and to form a top of the viscous chamber, such that the distributor rotates on the shaft. The stator includes at least one rib formed on a top surface thereof and extending toward the bearing, the rib having a spiral shape and inclined inward toward the shaft.

Other features and advantages of the present disclosure will become apparent from the following description of the invention, which refers to the accompanying drawings.

DETAILED DESCRIPTION OF THE EMBODIMENTS

Figure 1:
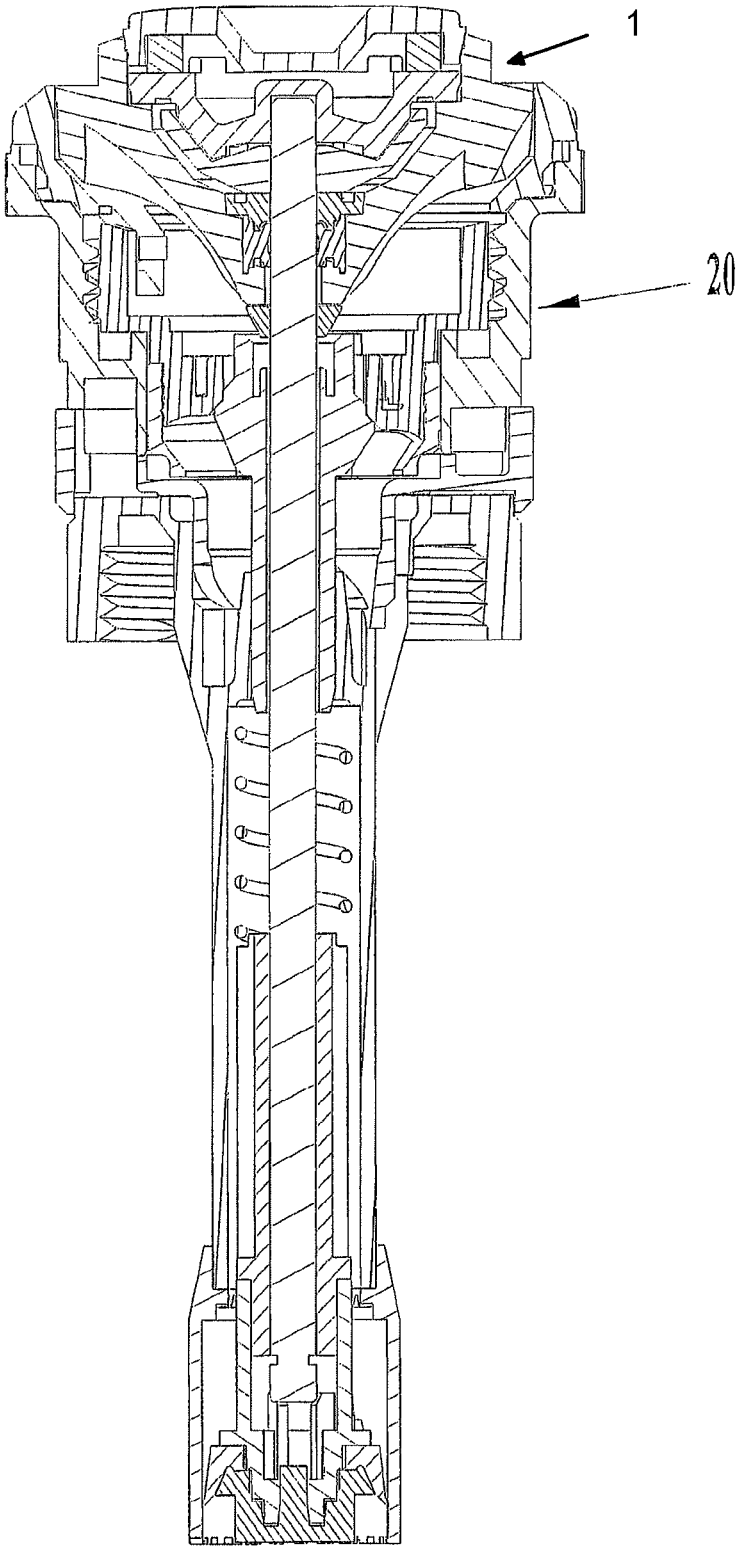
FIG. 1 is a cross section of a pop-up rotating stream deflector nozzle assembly, which is rotationally driven by the exiting streams with an internal viscous damping fluid and stator cavity in the rotating distributor.

FIG. 1 is a cross section of a pop-up rotating stream deflector nozzle assembly housing 20 that is rotationally driven by exiting streams of water. A rotating stream distributor 1 is mounted in the housing 20. The distributor includes a viscous damping chamber 12 that provides for speed control to ensure that the distributor does not overspin during use.

Figure 2:
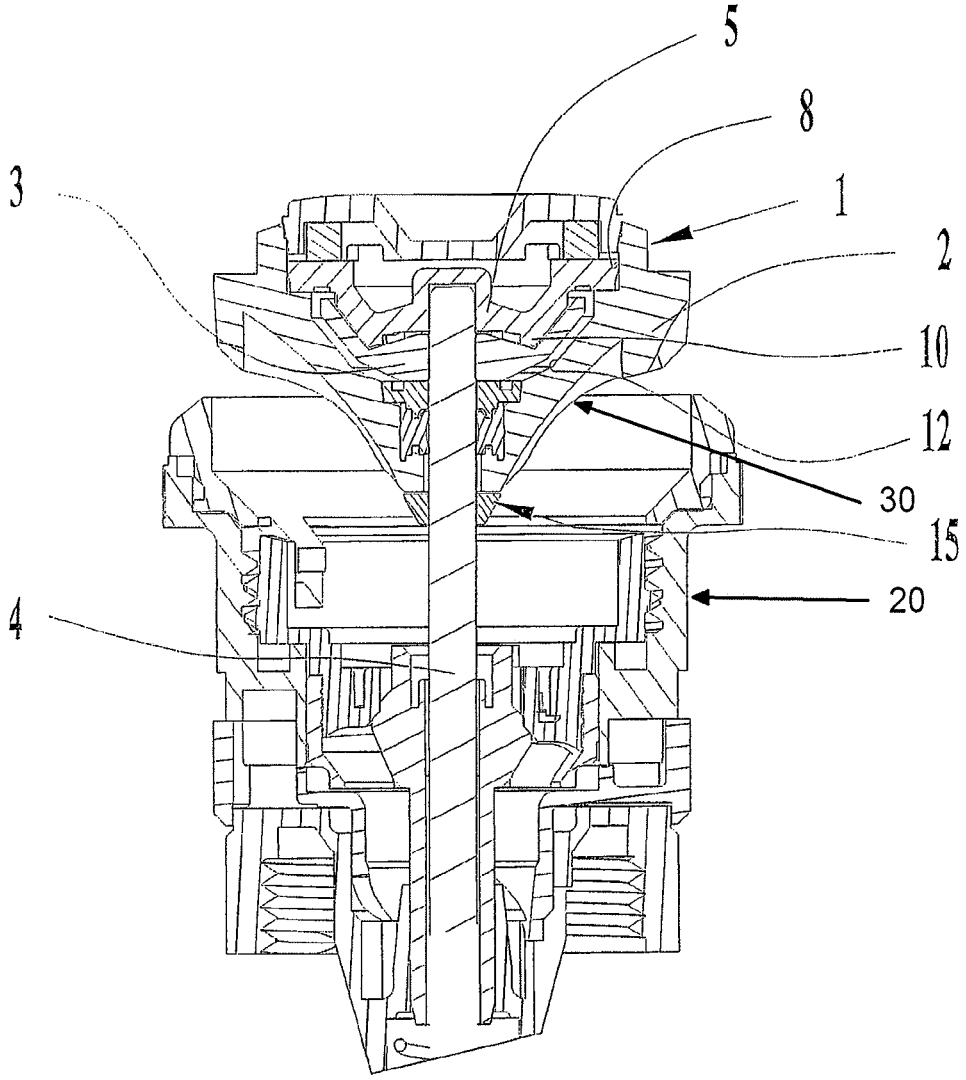
FIG. 2 is an enlarged view of the upper portion of this rotary nozzle assembly with the rotating stream distributor popped up out of the housing.

In FIG. 2, the details of the assembly 20 and distributor 1 are more clearly illustrated. The rotating stream distributor 1 is positioned along the central axis of the nozzle assembly housing 20. The rotating stream distributor 1 is shown in FIG. 2 popped up out of the nozzle assembly housing 20. The lower housing 2 of the distributor 1 has stream collection grooves 30 on its outside bottom surface with off radius components that cause the exiting stream to impart a rotational turning torque on the distributor 1 to rotationally drive it. The speed of rotation is limited by viscous damping in the viscous damping chamber 12 of the distributor.

In particular, the internal stator member 3 is press fitted onto center shaft 4. The upper bearing member 5 is press fitted into the opening 8 of the distributor 1 to be rotationally connected to the rotating distributor 1. A close running clearance is provided between the sloped spiral rib 10 on the bottom surface of the upper bearing member 5 and the stationary damping stator 3.

The open volume between shaft 4 with its press fitted damping stator 3 and the upper bearing member 5 in opening 8 of the rotary distributor 1 in the cavity 12 of the rotary distributor 1 is filled with viscous grease or other viscous fluid. As the distributor 1 rotates with the bearing member 5, based on the action of the exiting water streams, its rotational speed is limited by the small clearance between the stator 3 and the sloped spiral ribs 10. The sloped spiral ribs 10 cause the viscous fluid to be sheared and the inward spiral slope of the ribs 10 also causes the fluid to be pumped towards the center. This increases the fluid pressure at the center which forces any water or air that may have entered the viscous damping cavity 12 to the outside circumference of the damping cavity and along the trailing low pressure edge of the spiral ribs 10. The air and water is then moved by the upward sloping of the internal cavity walls up to the top of the cavity 12. Thus, the ribs 10 aid in viscous braking and ensure that viscosity of the fluid stays more or less constant by ensuring that water and air in the cavity are separated from the viscous fluid.

In an embodiment, a small deflector piece 15 may be provided on the stationary shaft 4 just upstream of the rotating joint between the rotating distributor 1 and the stationary shaft 4 to provide added protection against water being driven into the viscous damping cavity 12.

Figure 3:
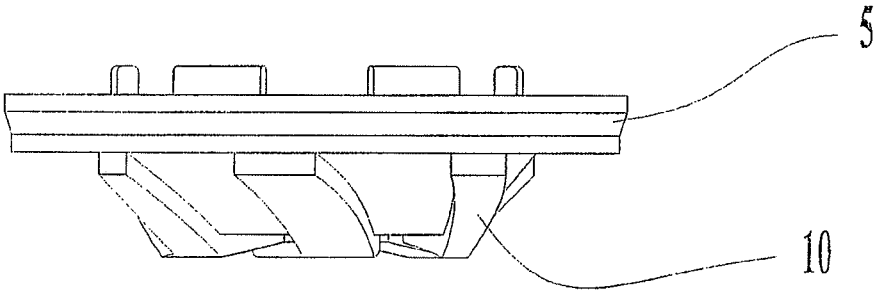
FIG. 3 shows a side view of the upper bearing member of the rotating stream deflector nozzle assembly of FIG. 1.
Figure 4:
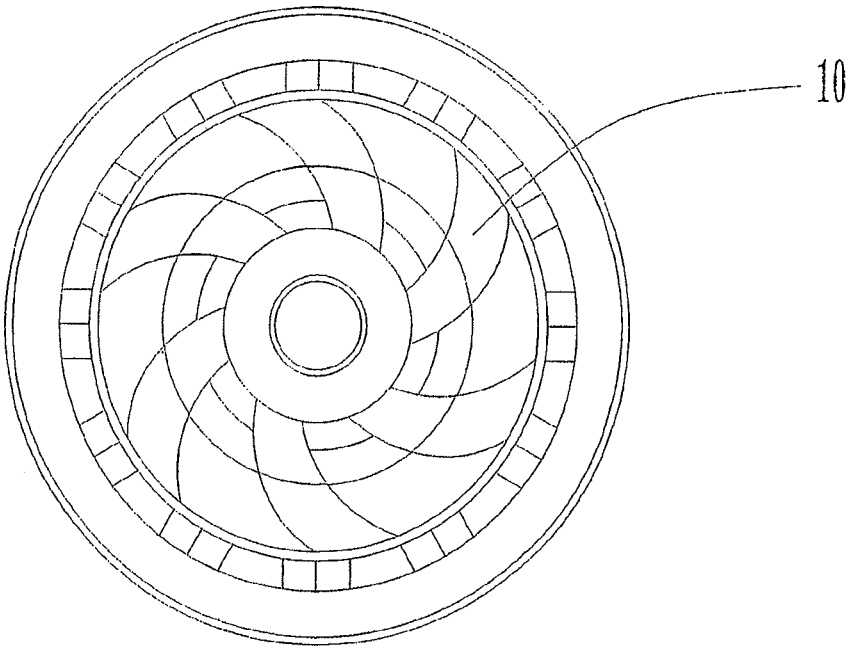
FIG. 4 shows a bottom view of the upper bearing member of the rotating stream deflector nozzle assembly of FIG. 1.

FIG. 3 illustrates a side view of the bearing member 5 with the inward slope of the spiral ribs 10 more clearly visible. FIG. 4 illustrates a bottom view of the bearing member 5 showing the spiral shape of the spiral ribs 10 more clearly shown.

While the sloped spiral rib 10 is preferably positioned on a bottom surface of the bearing member 5, in the alternative, the rib may be positioned on a top surface of the stator 3 and extend upward toward the bearing. Otherwise, the structure of the rib 10 is substantially the same as described above. That is, the ribs 10 have a spiral shape and are inclined, or sloped toward the shaft 4. In this embodiment, a plurality of ribs 10 may be provided on the top surface of the stator 3, if desired.

Although the present invention has been described in relation to particular embodiments thereof, many other variations and modifications and other uses will become apparent to those skilled in the art.

What is claimed is:

1. A distributor of a rotary sprinkler comprising:

a housing member including a plurality of curved grooves formed on a bottom surface thereof to impart torque on the distributor as water flows through the grooves;

a shaft positioned along a central axis of the distributor and extending through the distributor such that the distributor is rotatable on the shaft;

a viscous chamber formed in the housing and including a viscous material;

a stator, fixed to the shaft and positioned in the viscous chamber; and a bearing provided in a top surface of the housing member and, configured to rotatably connect the distributor to the shaft and to form a top of the viscous chamber, such that the distributor rotates on the shaft, wherein the shaft does not pass through the bearing and the bearing seals the top of the viscous chamber, the bearing further comprising at least one rib formed on a bottom surface thereof and extending toward the stator, the at least one rib having a spiral shape and inclined inward toward the shaft and configured to avoid contact with the stator when the sprinkler is in operation.

2. The distributor of claim 1, wherein the viscous material is a high viscosity liquid.

3. The distributor of claim 1, wherein the at least one rib includes a plurality of ribs formed on the bottom surface of the bearing, each rib of the plurality of ribs having a spiral shape and inclined toward the shaft.

4. The distributor of claim 3, wherein each rib of the plurality of ribs is inclined toward the shaft such that the viscous material in the viscous chamber is driven toward the shaft as the distributor rotates.

5. The distributor of claim 1, further comprising a deflector, positioned just upstream of a bottom surface of the housing and connected to the shaft to deflect water away from the viscous chamber.

6. A sprinkler head assembly comprising: a nozzle housing including an inlet for pressurize water and an outlet downstream of the inlet; a rotating deflector, mounted on a central shaft extending through the nozzle housing and operable to deflect a flow of water out of the nozzle assembly; the deflector further comprising: a housing member including a plurality of curved grooves formed on a bottom surface thereof to impart torque on the distributor as water flows through the grooves and is directed out of the nozzle assembly such that the deflector rotates on the central shaft; a viscous chamber formed in the housing member and including a viscous material; a stator, fixed to the central shaft and positioned in the viscous chamber; and a bearing provided in a top surface of the housing member and configured to rotatably connect the distributor to the central shaft and to form a top of the viscous chamber, the bearing further comprising at least one rib formed on a bottom surface thereof and extending toward the stator, the at least one rib having a spiral shape and inclined inward toward the shaft and configured to avoid contact with the stator when the sprinkler head assembly is in operation, wherein the shaft does not pass through the bearing and the bearing seals the top of the viscous chamber.

7. The sprinkler head assembly of claim 6, wherein the viscous material is a high viscosity liquid.

8. The sprinkler head assembly of claim 6, wherein the at least one rib includes a plurality of ribs formed on the bottom surface of the bearing, each rib of the plurality of ribs having a spiral shape and inclined toward the shaft.

9. The sprinkler head assembly of claim 8, wherein each rib of the plurality of ribs is inclined toward the shaft such that the viscous fluid in the viscous chamber is driven toward the shaft as the distributor rotates.

10. The sprinkler head assembly of claim 6, further comprising a deflector, positioned just upstream of a bottom surface of the housing and connected to the shaft to deflect water away from the viscous chamber.

11. A distributor of a rotary sprinkler comprising:

a housing member including a plurality of curved grooves formed on a bottom surface thereof to impart torque on the distributor as water flows through the grooves;

a shaft positioned along a central axis of the distributor and extending through the distributor such that the distributor is rotatable on the shaft;

a viscous chamber formed in the housing and including a viscous material;

a stator, fixed to the shaft and positioned in the viscous chamber; and a bearing provided in a top surface of the housing member, configured to rotatably connect the distributor to the shaft and to form a top of the viscous chamber, such that the distributor rotates on the shaft, wherein the shaft does not pass through the bearing and the bearing seals the top of the viscous chamber, the stator further comprising at least one rib formed on a top surface thereof and extending toward the bearing, the at least one rib having a spiral shape and inclined inward toward the shaft and configured to avoid contact with the bearing.

12. The sprinkler head assembly of claim 11, wherein the viscous material is a high viscosity liquid.

13. The sprinkler head assembly of claim 11, wherein the at least one rib includes a plurality of ribs formed on the top surface of the bearing, each rib of the plurality of ribs having a spiral shape and inclined toward the shaft.

14. The sprinkler head assembly of claim 13, wherein each rib of the plurality of ribs is inclined toward the shaft such that the viscous fluid in the viscous chamber is driven toward the shaft as the distributor rotates.

15. The sprinkler head assembly of claim 11, further comprising a deflector, positioned just upstream of a bottom surface of the housing and connected to the shaft to deflect water away from the viscous chamber.

* * * * *